United States Patent [19]

Braunagel

[11] Patent Number: 4,843,971

[45] Date of Patent: Jul. 4, 1989

[54] MONORAIL TRACK SYSTEM

[75] Inventor: Magnus V. Braunagel, Castle Rock, Colo.

[73] Assignee: Regis College, Denver, Colo.

[21] Appl. No.: 170,934

[22] Filed: Mar. 21, 1988

[51] Int. Cl.[4] ..... B61B 3/00

[52] U.S. Cl. ..... 104/94; 104/299; 104/300; 191/23 A

[58] Field of Search ..... 104/93, 94, 107, 108, 104/109, 118, 140, 242, 243, 244, 245, 246, 295, 299, 300, 301; 191/23 R, 23 A, 35, 14; 246/27, 28 R, 31, 62, 72, 73, 167 R, 182 R; 180/168

[56] References Cited

U.S. PATENT DOCUMENTS

| | | | |
|---|---|---|---|
| 2,052,972 | 9/1936 | Frank et al | 191/23 A |
| 4,099,591 | 7/1978 | Carr | 180/168 |
| 4,137,424 | 1/1979 | Hesse et al. | 191/23 A |
| 4,144,954 | 3/1979 | Farello et al. | 188/165 |
| 4,362,108 | 12/1982 | Jenkner | 104/243 |
| 4,375,193 | 3/1983 | Sullivan | 104/118 |
| 4,641,586 | 2/1987 | Miller et al. | 104/284 |
| 4,690,064 | 9/1987 | Owen | 104/28 |

FOREIGN PATENT DOCUMENTS

| | | | |
|---|---|---|---|
| 1658305 | 9/1970 | Fed. Rep. of Germany | 104/109 |
| 737449 | 9/1955 | United Kingdom | 191/23 A |

*Primary Examiner*—Robert B. Reeves
*Assistant Examiner*—Brian Sells
*Attorney, Agent, or Firm*—Dorr, Carson, Sloan & Peterson

[57] ABSTRACT

A suspended monorail track system has a box-shaped cross section with flanges extending inward and upward from the bottom edges of the side walls to form an acute angle between each flange and its attached side wall. An opening remains between the flanges extending along the bottom of the track. An intermediate horizontal wall may be added below the top wall to form an enclosed channel for power and signal cables within the track. A number of power and signal conductors extend along the interior surfaces of the track to provide electrical contact with vehicles moving along the track. Signal conductors are used to prevent collision between vehicles. Each vehicle is suspended from the track by a bogie assembly extending through the opening along the bottom of the track. The bogie assembly is supported by load-bearing wheels riding on the upper surfaces of the flanges, and stabilized by a second set of wheels rolling along the bottom surfaces of the flanges. A series of markings, such as vertical stripes, fixed along the interior of the track are optically scanned from the bogie assembly and used to regulate the speed of each vehicle.

6 Claims, 8 Drawing Sheets

MONORAIL TRACK SYSTEM

BACKGROUND OF THE INVENTION

I. Field of the Invention

This invention relates generally to monorail transportation systems, and more specifically to a suspended monorail track system.

II. Prior Art

A number of prior art references show monorail tracks having a generally boxed-shaped or U-shaped cross section. A number of these references also show monorail tracks having horizontal flanges extending laterally inward from the bottom edges of the side walls of the track. Other references include a number of power conductors or signal conductors inside the track to provide power, communications, or control signals to vehicles along the track. However, none of these references show the use of upwardly inclined flanges, or the unique arrangement of power and signal conductors within the track as taught in the present invention. In addition, the speed control and anticollision systems incorporated in the present invention constitute a major improvement over the prior art.

SUMMARY OF THE INVENTION

The present invention involves a suspended monorail track system having a boxed-shaped cross section with flanges extending inward and upward from the bottom edges of the side walls to form an acute angle between each flange and its attached side wall. An opening remains between the flanges extending along the bottom of the track. An intermediate horizontal wall may be added below the top wall to form an enclosed channel for power and signal cables within the track. A number of power and signal conductors extend along the interior surfaces of the track to provide electrical contact with vehicles moving along the track. Signal conductors are used to prevent collision between vehicles. Each vehicle is suspended from the track by bogie assembly extending through the opening along the bottom of the track. The bogie assembly is supported by a set of wheels riding on the upper surfaces of the flanges, and stabilized by a second set of wheels riding along the bottom surfaces of the flanges. A series of markings affixed along the interior of the track are optically scanned from the bogie assembly and used to regulate the speed of each vehicle.

A principal object of the present invention is to provide a safe, economical, and reliable monorail track system. Other objects of the present invention are to provide a track that is resistant to vandalism and tampering. In particular, any foreign objects, ice, or water finding their way into the track will tend to collect outside of the wheel rolling surfaces on the flanges. In addition, the speed control and anticollision systems incorporated into the track system eliminate the need for human operators for each vehicle.

BRIEF DESCRIPTION OF THE DRAWINGS

The present invention can be better understood in conjunction with the accompanying drawings, wherein.

DETAILED DESCRIPTION OF THE INVENTION

Figure 1:
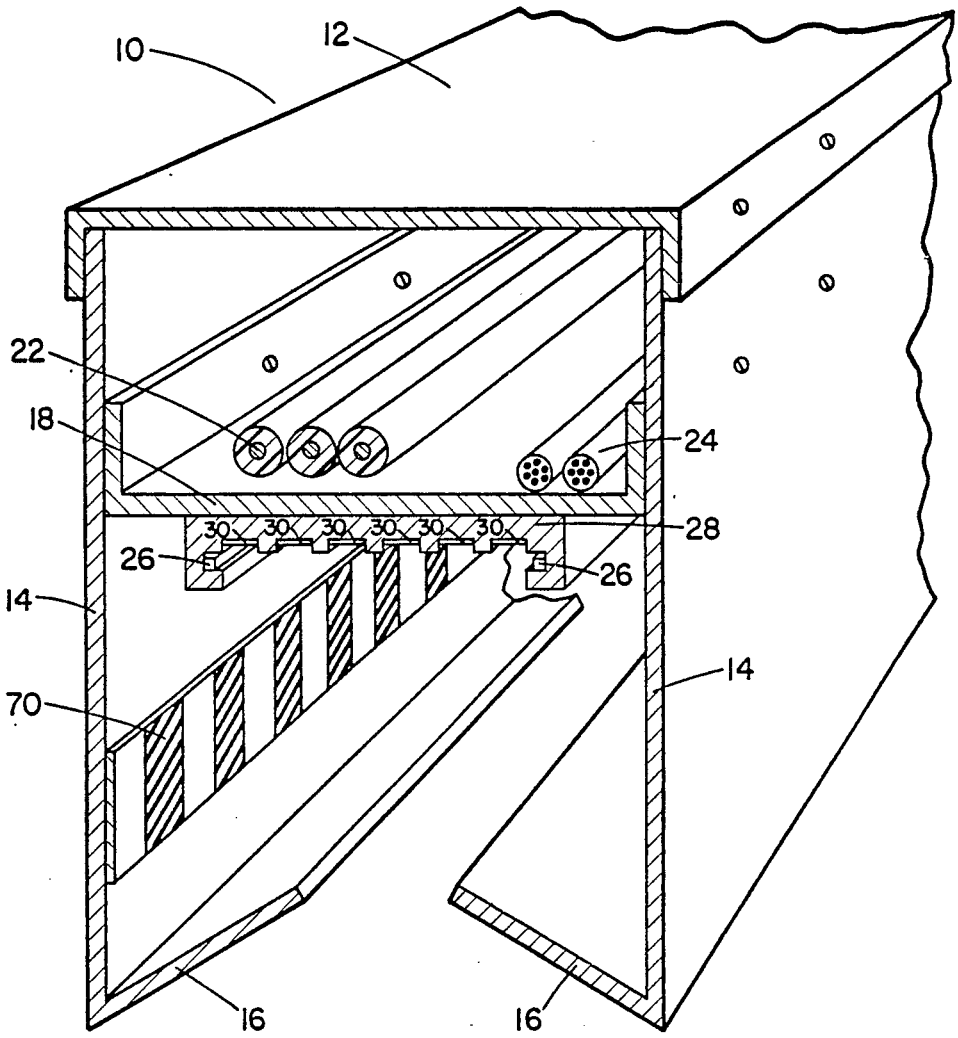
FIG. 1 is a vertical cross sectional view of the monorail track.

A perspective end view of the track 10 is shown in FIG. 1. The track has a box-shaped cross section with a top horizontal wall 12; two side walls 14 extending downward from the edges of the top wall; and two flanges 16 extending laterally inward and upward from the bottom edges of the side walls, so that acute An intermediate horizontal wall 18 extends between the side walls near the top of the track to form an enclosed chamber for power cables 20 and signal cables 24. This shape and construction of the track was selected because any rainwater or moisture entering the interior of the track will tend to collect in the corners between the flanges and the side walls, and hence will not interfere with the path of the vehicle wheels on the upper portion of the flanges. Similarly, any rocks or other foreign objects that could be projected into the opening between the flanges will also tend to slide into the corners between the flanges and the side walls, out of the path of the vehicle wheels. Any ice forming either inside or outside the track will tend to accumulate at the lower corners of the track, out of the path of the vehicle wheels. The upward slant of the flanges also serves to provide motional stability and self-centering for the bogie assembly used to suspend the vehicles from the track.

Power cables 22 extend the length of the chamber created between the top and intermediate horizontal plates. Power is transferred to each vehicle by means of two exposed conductors 26 within the main chamber of the track. Matching contacts attached to the bogie assembly for each vehicle slide along these conductors. A number of signal and communications cables 24 also extend along the track. These cables are in electrical communication with a number of exposed conductors 30 within the main chamber of the track used to maintain control and communications through matching slider contacts on the bogie assembly for each vehicle. In the preferred embodiment, the power contacts carry a high voltage and are mounted on the interior faces of two opposing C-shaped brackets 28 to protect against possible contact with any conducting object inserted through the opening in the bottom of the track. Enclosure of the conductors in this manner within the track provides magnetic shielding of sparks to minimize interference with local radio or television reception.

Figure 2:
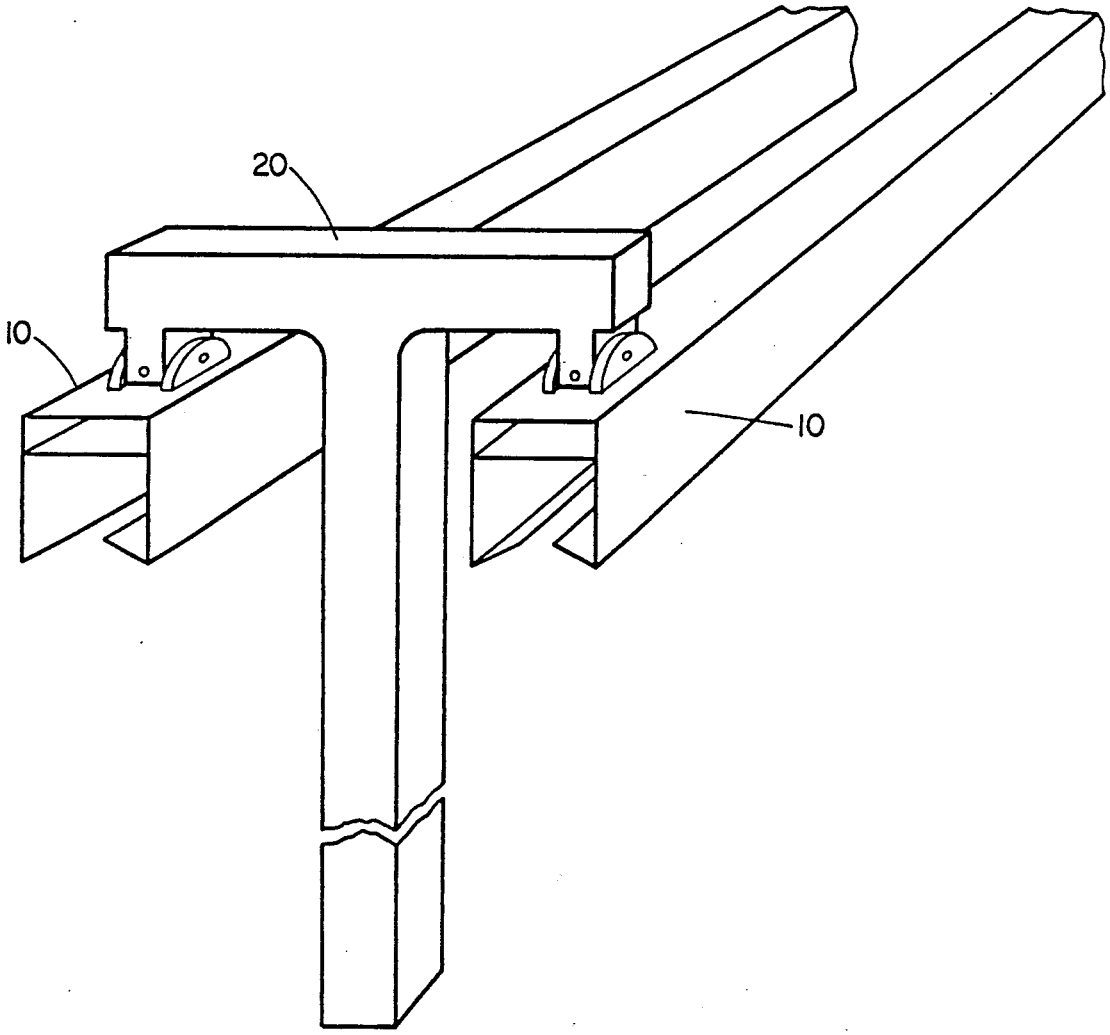
FIG. 2 is a perspective view showing one manner by which two tracks are supported above the ground by means of a T-shaped support.

FIG. 2 shows one method of suspending the track 10 above the ground from a T-shaped support 20. Virtually any other type of conventional support member used for monorails, overhead conveyors, or ski lifts would suffice.

Figure 3:
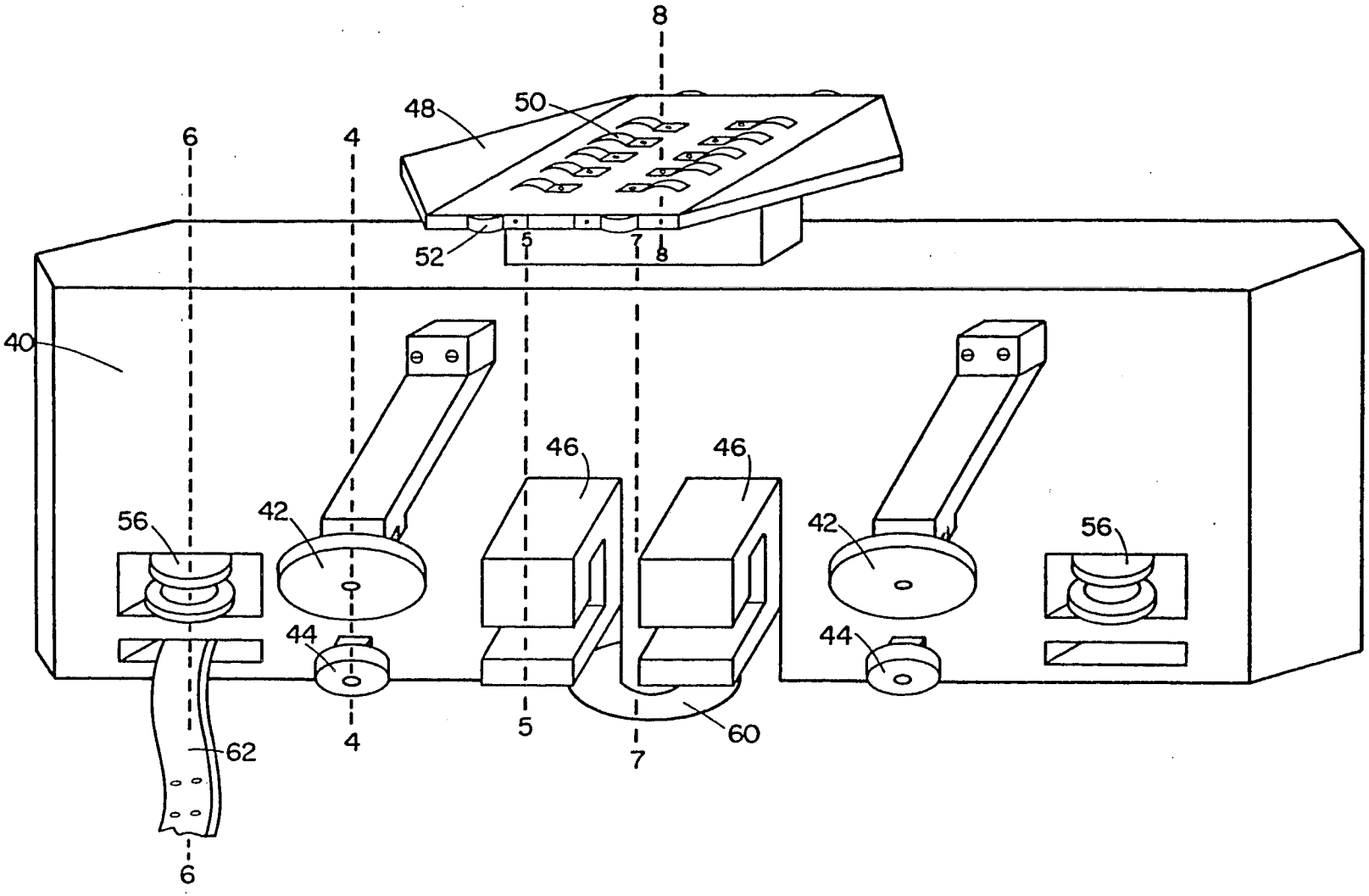
FIG. 3 is a perspective view showing the bogie assembly used to attach the monorail vehicle to the track.

FIG. 3 shows the bogie assembly 40 used to attach each vehicle to the track 10. Various vertical cross sections are shown in greater detail in FIGS. 4 through 9. Each vehicle is usually supported by at least two bogie assemblies located at either end of the vehicle. In general, the main body of the bogie assembly 40 extends upward from the vehicle through the opening in the bottom of the track. The vehicle is attached to the bogie FIG. 7, and by two supplemental safety straps 62. Two pairs of larger wheels 42 are rotatably attached to the bogie assembly and ride on the top surfaces of the flanges. Smaller stabilization wheels 44 prevent excessive lateral motion of the bogie assembly by riding against the bottom surfaces of the flanges. Electromagnetic brakes 46 straddle the flanges. A slider mechanism 48 attached to the top of the bogie assembly slides along the track between the C-shaped brackets 28, as shown in FIGS. 1 and 8. Slider contacts 50 are aligned to remain in electrical contact with the signal conductors 30 for communication and control of the vehicle. Other slider contacts 52 are in electrical contact with the power conductors 26.

Figure 4:
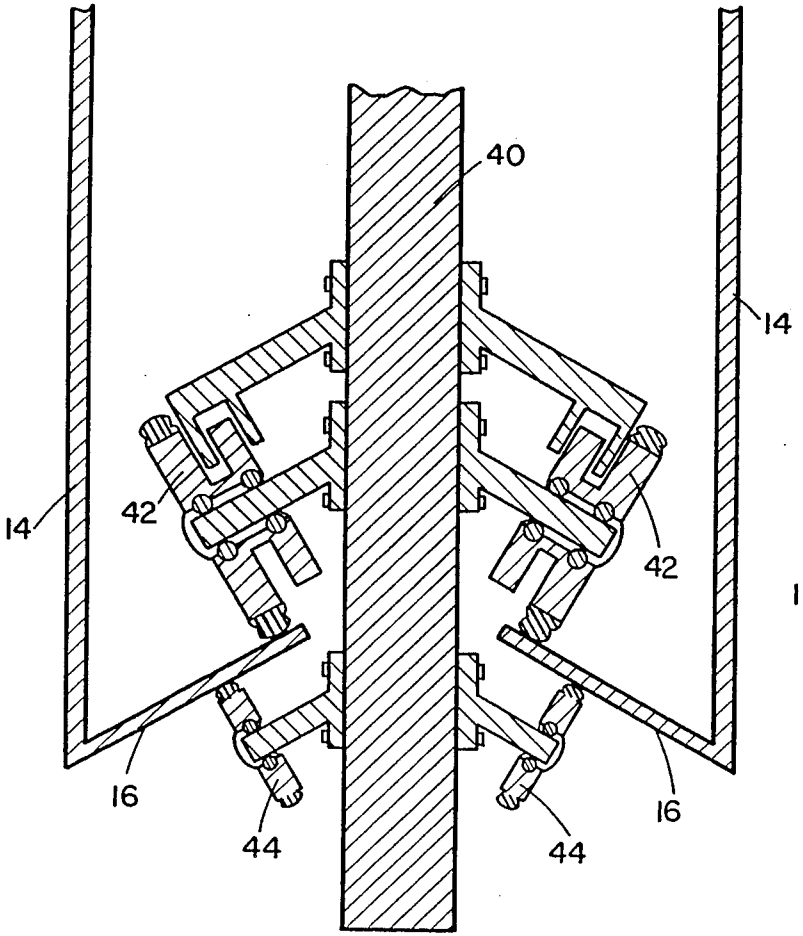
FIG. 4 is a cross sectional view taken along the line 4—4 in FIG. 3, showing the wheels used to support and stabilize the bogie assembly with respect to the track.

FIG. 4 is a vertical cross sectional view of the bogie assembly taken through line 4—4 in FIG. 3, showing the details of the supporting and stabilizing wheels. The supporting wheels 42 are placed at an angle so that they are perpendicular to the flanges 16. A molded non-metalic tire is used to substantially eliminate rolling noise. These supporting wheels are the only components of the bogie assembly that experience large loads. The only purpose of the lower stabilizing wheels is to prevent any appreciable movement of the bogie assembly within the track when the vehicle is caused to sway by external wind loads. The stabilizing wheels only experience relatively small lateral guiding forces. The forces exerted by the supporting wheels 42 on the flanges include an inwardly-directed component that tends to force the flanges toward each other. These forces tend to structurally stabilize the track. In addition, these forces partially counteract the movement created in the side walls by vertical loads on the flanges, thus allowing thinner construction of the side walls. On the inside of each supporting wheel is attached an emergency disk brake. These disk brakes are activated electrically and are used to automatically stop the vehicle in the event external electrical power is cut off. Thus, the vehicle is prevented from rolling should this happen in a place where the track is inclined. The disk brakes are also used as a backup braking system for the electromagnetic brakes.

Figure 5:
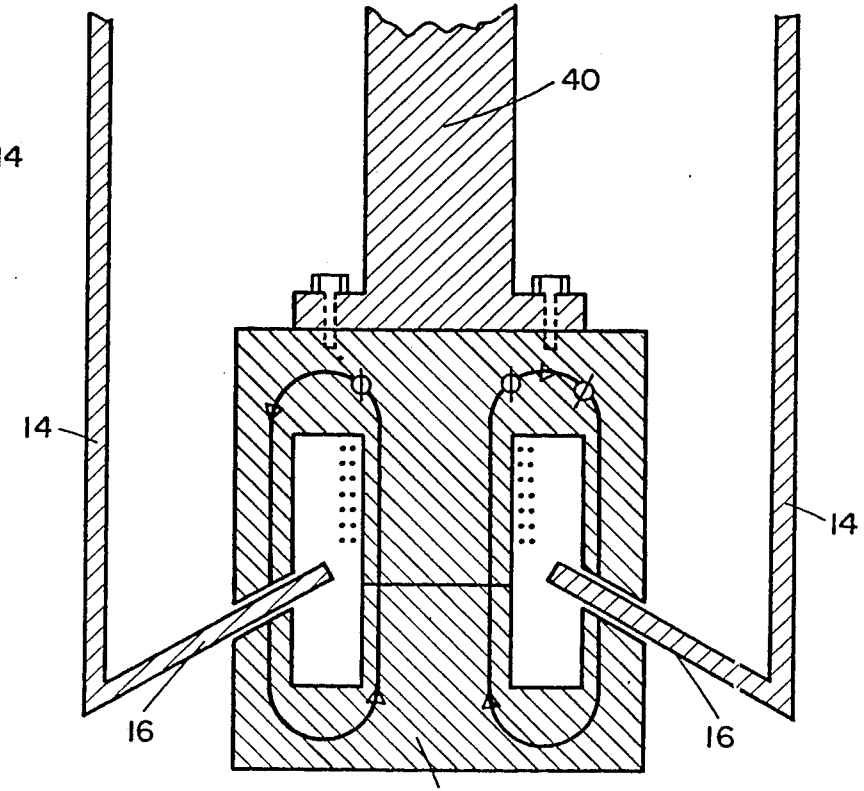
FIG. 5 is a cross sectional view taken along line 5—5 in FIG. 3, showing the electromagnetic brake attached to the bogie assembly.

FIG. 5 is a vertical cross sectional view of the bogie assembly through line 5—5 in FIG. 3, showing the electromagnetic brake 46. The track flanges 16 extend through the lateral openings in the electromagnetic brake. The stabilizing wheels restrict movement of the bogie assembly so that the track flanges do not interfere with the electromagnetic brake clearances. A magnetic field is created through the brake by passing an electrical current through a wire coil. The movement of the flanges through the magnetic field creates a braking force. The electromagnetic brake offers the following advantages:

(1) The life of an electromagnetic brake is unlimited since there are no frictional surfaces to wear or any moving parts.

(2) The braking force produced by the electromagnetic brake is very easy to control electrically since it is determined by the current flowing through the brake coil.

(3) The braking action of an electromagnetic brake is always smooth, and hence will never produce an unsteady or jerky motion in the vehicle during the braking action.

(4) The electromagnetic flux passes vertically through the track flanges. Thus, the movement of the track flange within the electromagnetic brake flux gap will not alter the magnitude of the braking force produced.

(5) The braking force produced by the electromagnetic brake lies along the length of the flange and does not produce any destabilizing vertical forces, and hence does not produce any additional forces on the load-supporting wheels of the bogie assembly.

(6) The electromagnetic brake does not produce any appreciable amount of heat in the flange during braking.

(7) The electromagnetic brake is noise-free since it does not produce any frictional or rubbing noises.

Figure 6:
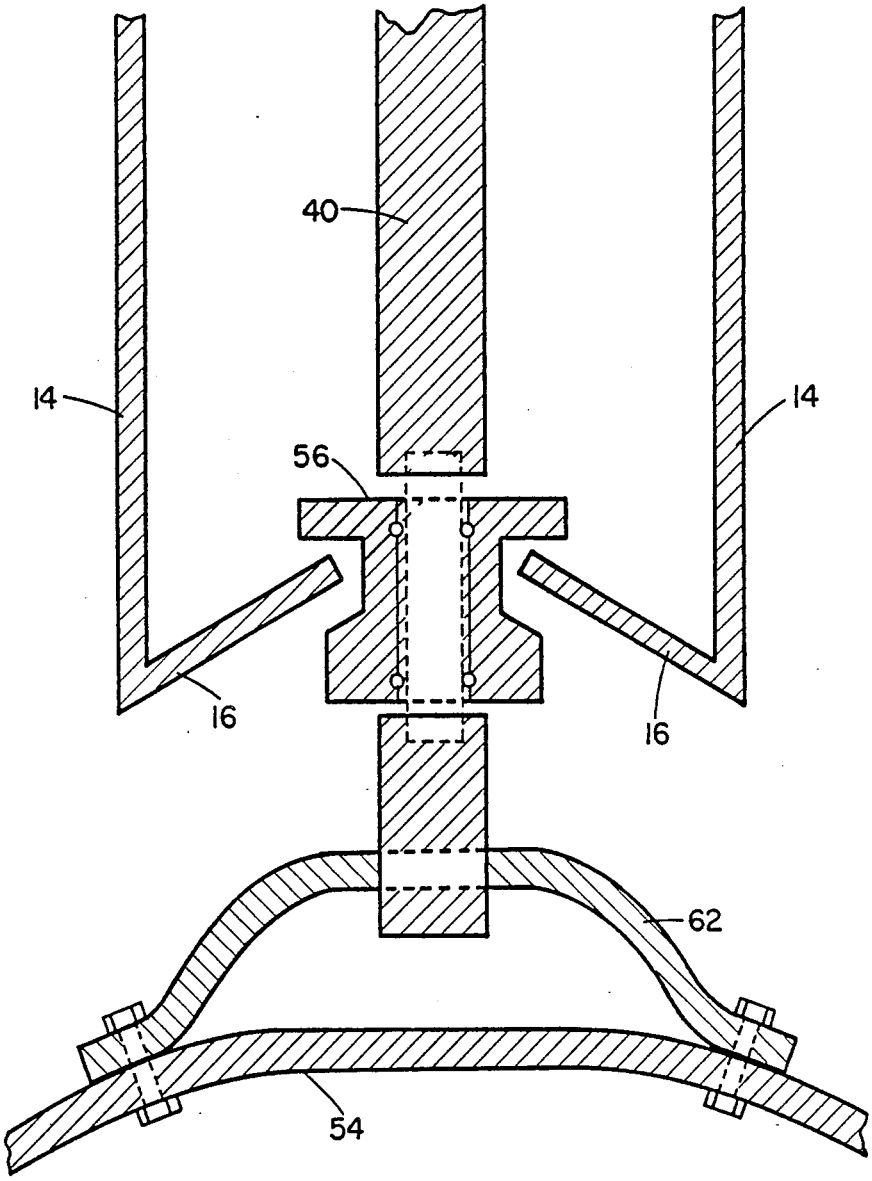
FIG. 6 is a cross sectional view taken along line 6—6 in FIG. 3, showing the safety strap fastened between the bogie assembly and the monorail vehicle.
Figure 7:
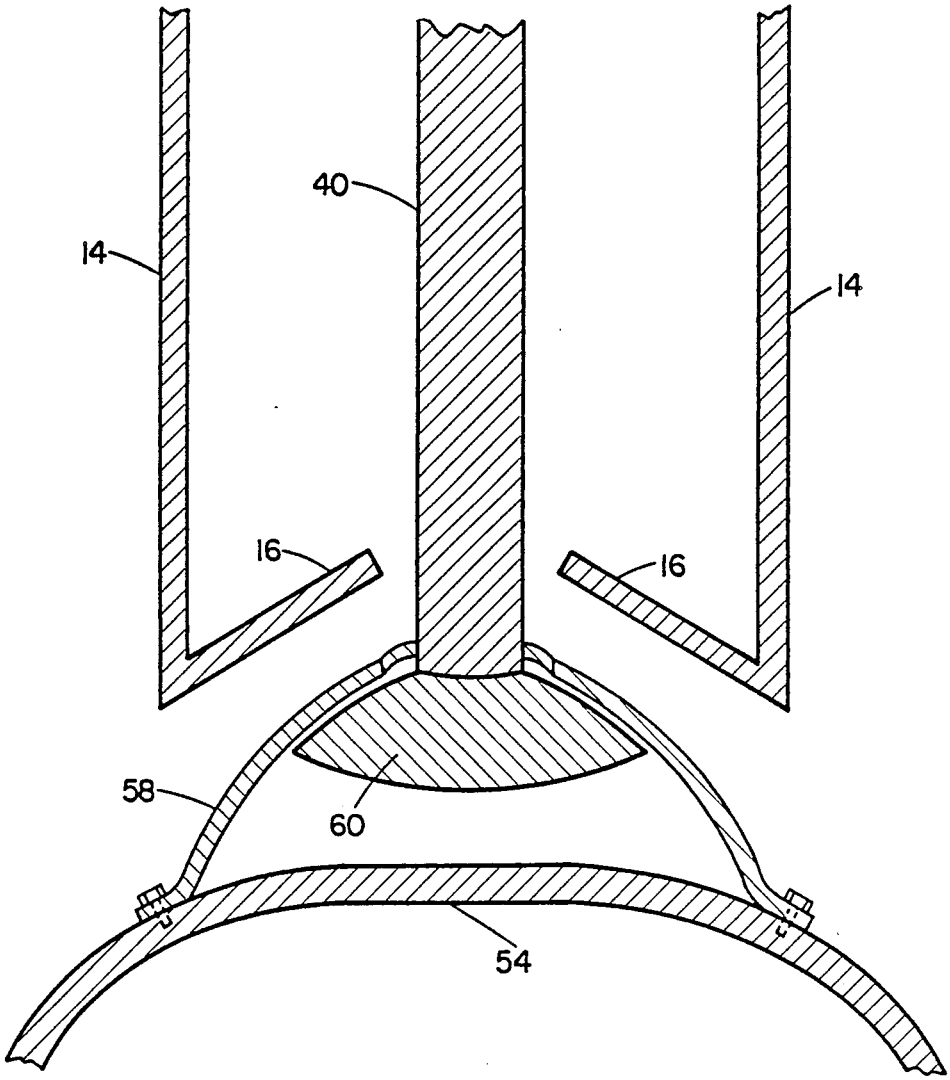
FIG. 7 is a cross sectional view taken along line 7—7 in FIG. 3, showing the main support between the bogie assembly and the monorail vehicle.
Figure 8:
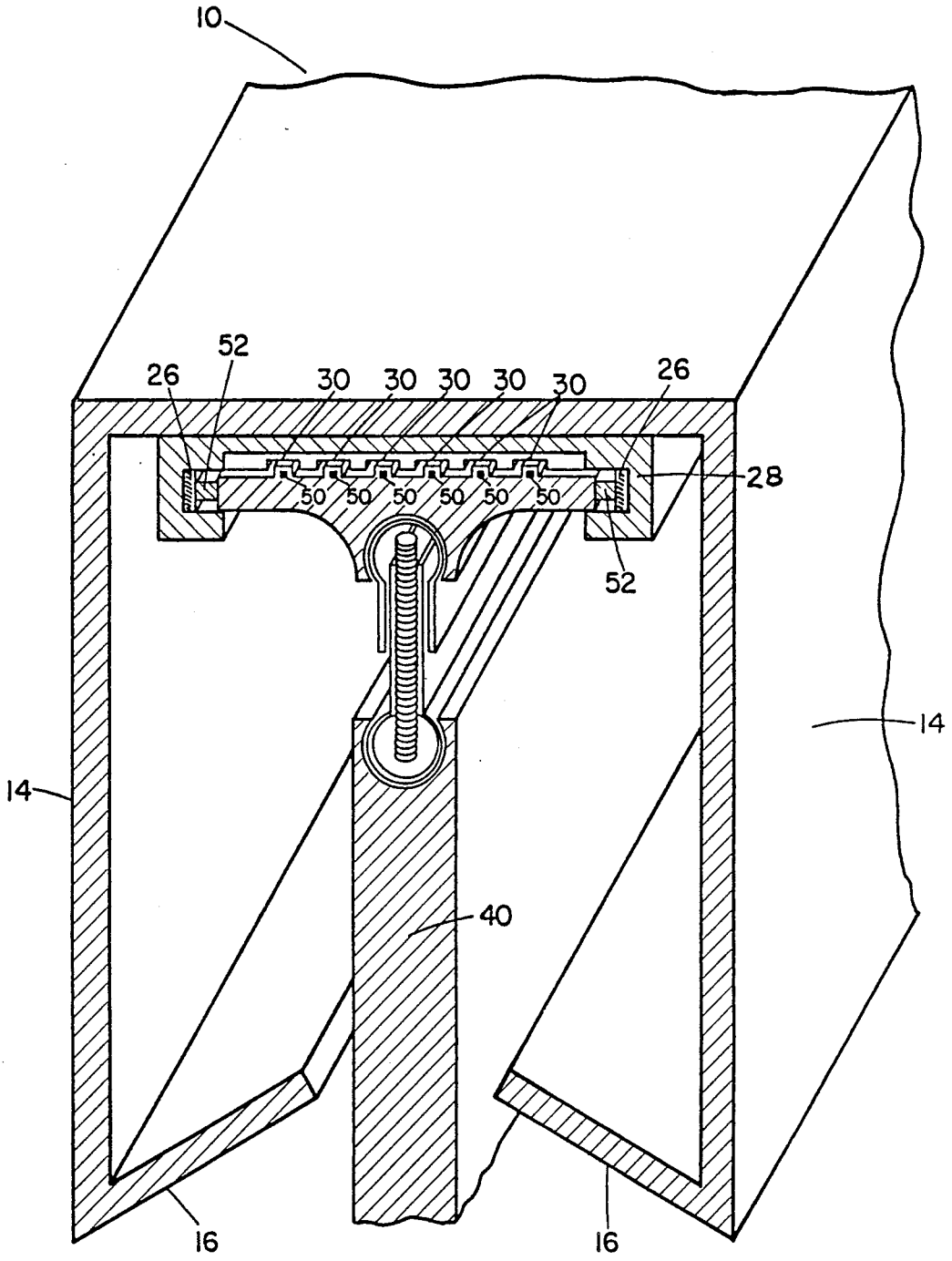
FIG. 8 is a cross sectional view taken along line 8—8 in FIG. 3, showing the electrical contacts attached to the slider mechanism of the bogie assembly, and the manner by which these contacts meet the power and signal conductors extending along the interior top surface of the track.

FIGS. 6 and 7 are vertical cross sectional views of the bogie assembly taken along lines 6—6 and 7—7 in FIG. 3, showing details of the attachment between the vehicle and the bogie assembly. FIG. 6 shows one of the safety straps 62 and guide wheels 56 that provide redundant support for the vehicle in the event of structural failure of the primary attachments shown in FIG. 7. The primary attachment comprises a spherical segment 60 attached to the bottom of the bogie assembly. A corresponding spherical bracket 58 is mounted to the top of the vehicle to hold the spherical segment 60. This permits limited three-dimensional movement of the vehicle with respect to the bogie assembly. Thus, swaying movement of the car induced by wind loads will not cause any substantial bending or destabilizing forces in the bogie assembly or track. The bogie assembly is also able to make necessary lateral movements at track switching points and to follow the curvature of the track.

FIG. 8 is a vertical cross sectional view of the track 10 and bogie assembly 40 along line 8—8 in FIG. 3, showing the slider mechanism used to maintain electrical contact with the power conductors 26 and signal conductors 30 in the track. The slider mechanism is attached to the top of the bogie assembly by means of a spring-loaded mechanism which enables the slider to remain in proper position and alignment despite lateral or swaying movement of the bogie assembly.

Figure 9:
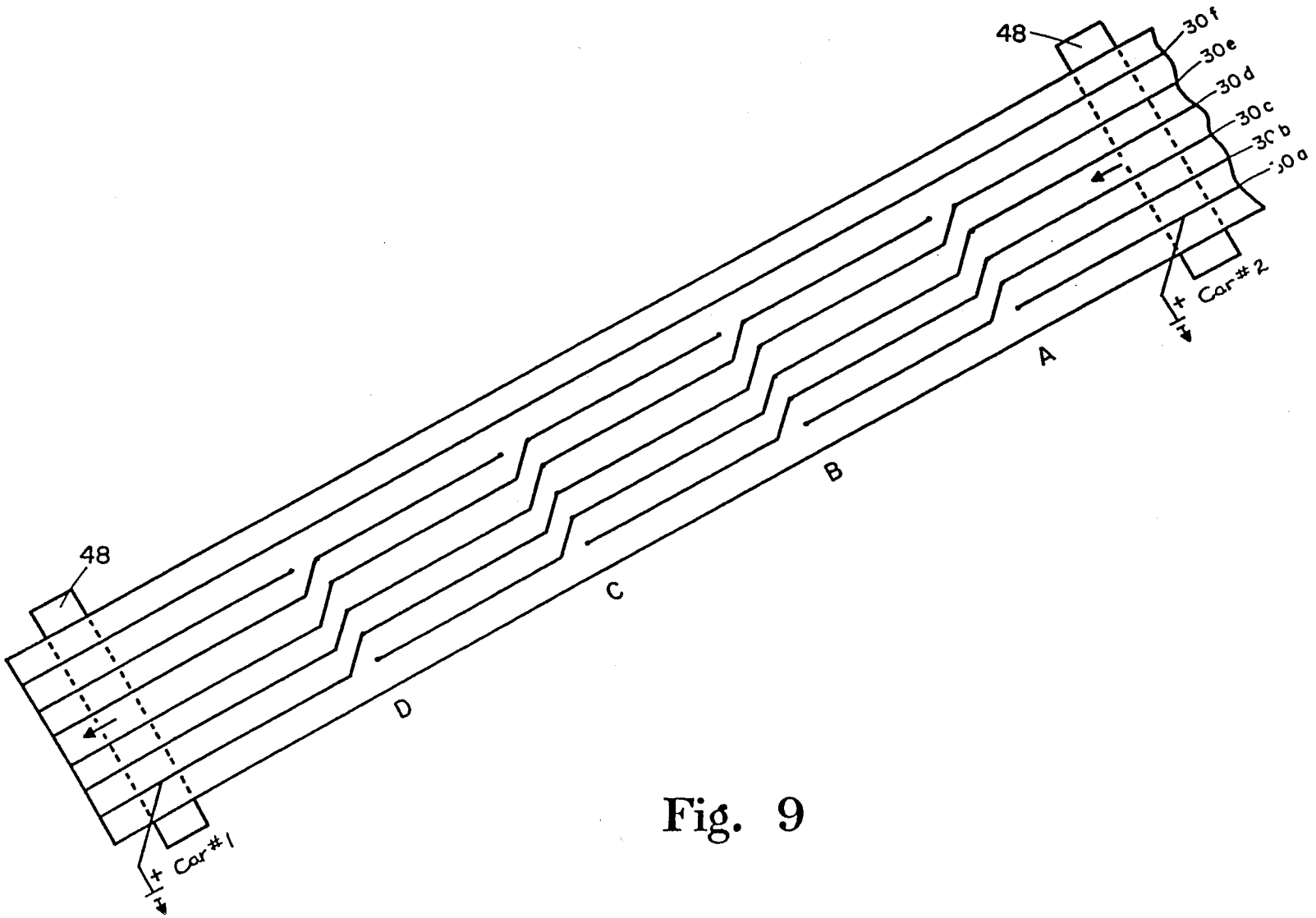
FIG. 9 is a schematic representation showing the use of parallel signal conductors in the track as an anticollision system.

FIG. 9 is a schematic representation of the anticollision system incorporated in the present invention by the signal conductors **30*a* through 30*f* extending with uniform parallel spacing along the interior top surface of the track as shown in FIGS. 1 and 8. The position of each conductor is shifted by one spacing at a series of predetermined locations along the track. These points are indicated as A through D in FIG. 9. Each vehicle continuously supplies a low voltage signal to its conductor 30*a*. Suppose Car No. 1 is in the position shown in FIG. 9. Furthermore, let us assume that Car No. 1 remains stationary as Car No. 2 approaches. As Car No. 2 moves to the position shown a voltage would appear on its conductor 30***e*. The presence of this low voltage at conductor 30*e* would cause the speed of Car No. 2 to be reduced by 80% of scheduled speed. Suppose now that Car No. 2 continues its movement forward to a position between points A and B while Car No. 1 remains stationary. A voltage now appears on conductor 30*d* for Car No. 2. The presence of this low voltage on conductor 30*d* would reduce the speed of Car No. 2 to 50% of its scheduled speed. Now suppose that Car No. 2 continues its movement forward to a position between points B and C while Car No. 1 remains stationary. A low voltage signal would now appear on conductor 30*c*, which would cause electrical power to be disconnected from the motor of Car No. 2 and would also activate the brakes to bring Car No. 2 to a complete stop. Car No. 2 would remain stopped until Car No. 1 has moved forward a distance sufficient so that all voltages have been removed from conductors 30*c* through 30*e* of Car No. 2. By means of this anticollision system, the minimum spacing that will always be maintained between adjacent vehicles is the distance between each of the points A through D. This minimum spacing is adjusted simply by changing the various crossover points for the signal conductors. The spacing can also be varied along the track to account for traffic patterns and the location of stations. It should also be noted that the anticollision signal is generated by the electrical system within each vehicle and transmitted and detected by redundant slider contacts which are inaccessible at the top interior surface of the monorail. Thus, it is virtually impossible to externally tamper or inactivate the anticollision system.

To maintain accurate car arrival and departure schedules at each station and to accurately maintain spacing between cars moving along the same track, it is important to have an accurate speed control for each vehicle. Furthermore, the speed of each vehicle must be varied at different segments along the route and as the vehicle approaches and leaves the station. As shown in FIG. 1, black and white vertical stripes 70 are affixed along one side of the interior of the track. The width and spacing of these markings varies along the vehicle's route. At those route segments where the vehicle is to possess the greatest speed, these vertical stripes would have the greatest width and spacing. On the other hand, as the vehicle approaches a station, these stripes would become narrower and more closely spaces. An optical scanner is fastened to the side of the bogie assembly for each car to scan the rate at which these stripes pass through the field of view of the scanner. The scanner generates an output signal which is proportional to the rate at which these stripes pass in front of the scanner, and which in turn is used to control the speed of the vehicle and to determine whether the electromagnetic brake is activated. Note that the speed control system is completely passive in that it does not depend on any type of electromagnetically radiated signals. The redundancy and location of the optical scanners within the track makes it virtually impossible to vandalize or disable the car's speed control system either from inside or outside of the vehicle.

I claim:

1. A suspended monorail track system comprising:

(a) A top horizontal wall;

(b) Two side walls extending downward from the lateral edges of the top wall;

(c) Flanges extending inward and upward from the bottom edges of the side walls, such that each flange forms an acute angle with respect to its attached side wall;

(d) An intermediate horizontal wall extending between said side walls, below said top wall and above said flanges, forming a substantially enclosed interior channel extending along the length of the track;

(e) A pair of C-shaped channels extending parallel to and downward from said intermediate wall, with both channels opening toward the mid-line of the track; and (f) A pair of power conductors, one conductor extending long the inside face of each C-shaped channel.

2. The suspended monorail track system of claim 1, further comprising a number of signal conductors extending in parallel along the interior of the track.

3. The suspended monorail track system of claim 1, further comprising a bogie assembly for suspending a vehicle from the track, comprising:

(a) A frame attached to the vehicle extending upward through the opening between the track flanges; and (b) A number of supporting wheels rotatably mounted to the frame inside the track, in rolling engagement with the top surfaces of the track flanges.

4. The suspended monorail track system of claim 3, further comprising a number of stabilizing wheels rotatably mounted to the frame and rolling along the bottom surfaces of the track flanges.

5. The suspended monorail track system of claim 3, further comprising an electromagnetic brake, attached to the bogie assembly frame, passing an electromagnetic flux through the track flanges as the bogie assembly moves along the track, thus creating a braking force for the bogie assembly.

6. A suspended monorail track system comprising:

(a) A top horizontal wall;

(b) Two side walls extending downward from the lateral edges of the top wall;

(c) Flanges extending inward and upward from the bottom edges of the side walls, such that each flange forms an acute angle with respect to its attached side wall;

(d) A bogie assembly for suspending a vehicle from the track, comprising:

(i) A frame attached to the vehicle extending upward through the opening between the track flanges; and (ii) a number of supporting wheels rotatably mounted to the frame inside the track, in rolling engagement with the top surfaces of the track flanges;

(e) A number of signal conductors extending in parallel along the interior of the track with uniform spacing, and with a the position of each conductor shifting by on spacing at each of a series of predetermined locations along the track; and (f) An anti-collision system for each vehicle, comprising:

(i) An electrical signal generating means for each vehicle to apply an electrical signal to a predetermined signal conductor; and (ii) Control means for monitoring electrical signals appearing on the remaining signal conductors, and thereby regulating the speed of the vehicle.

* * * * *